United States Patent [19]

Peetz et al.

[11] Patent Number: 4,951,761

[45] Date of Patent: Aug. 28, 1990

[54] ROCK DRILL

[75] Inventors: Wolfgang Peetz, Blitzenreute; Bernhard Moser, Altshausen; August Haussmann, Oberzell, all of Fed. Rep. of Germany

[73] Assignee: Hawera Probst GmbH & Co., Ravensburg, Fed. Rep. of Germany

[21] Appl. No.: 359,122

[22] Filed: May 31, 1989

[30] Foreign Application Priority Data

Jun. 18, 1988 [DE] Fed. Rep. of Germany ..... 3820695

[51] Int. Cl.[5] ..... B28D 1/14; B28D 7/02; E21B 10/44; E21B 10/58

[52] U.S. Cl. ..... 175/398; 175/394; 175/400; 175/410; 175/415

[58] Field of Search ..... 175/410, 323, 394, 398, 175/400, 401, 415; 76/108 R, 108 A; 408/705

[56] References Cited

U.S. PATENT DOCUMENTS

| | | | |
|---|---|---|---|
| 2,507,222 | 5/1950 | Phipps | 175/410 X |
| 3,163,244 | 12/1964 | Zimmerman | 175/410 X |
| 3,294,186 | 12/1966 | Buell | 175/410 |
| 3,845,829 | 11/1974 | Schaumann | 175/410 X |
| 4,696,355 | 9/1987 | Haussmann | 175/410 X |

FOREIGN PATENT DOCUMENTS

| | | | |
|---|---|---|---|
| 677997 | 1/1964 | Canada | 175/410 |
| 757076 | 5/1951 | Fed. Rep. of Germany . | |
| 912202 | 5/1954 | Fed. Rep. of Germany . | |
| 918383 | 9/1954 | Fed. Rep. of Germany | 175/410 |
| 2841679 | 4/1980 | Fed. Rep. of Germany . | |
| 2912394 | 10/1980 | Fed. Rep. of Germany . | |
| 3025890 | 1/1982 | Fed. Rep. of Germany . | |
| 8104116 | 8/1982 | Fed. Rep. of Germany . | |
| 3544433 | 6/1987 | Fed. Rep. of Germany . | |
| 889080 | 12/1942 | France | 175/410 |
| 302460 | 1/1955 | Switzerland | 175/410 |
| 637237 | 5/1950 | United Kingdom | 175/410 |

*Primary Examiner*—Stephen J. Novosad
*Attorney, Agent, or Firm*—Spencer & Frank

[57] ABSTRACT

A rock drill having a drilling head which, in an asymmetric arrangement relative to the main cutting tip, has at least one additional secondary cutting tip, the angle enclosed between the single cutting edge of the main cutting tip and the secondary cutting tip being formed as an acute angle.

11 Claims, 1 Drawing Sheet

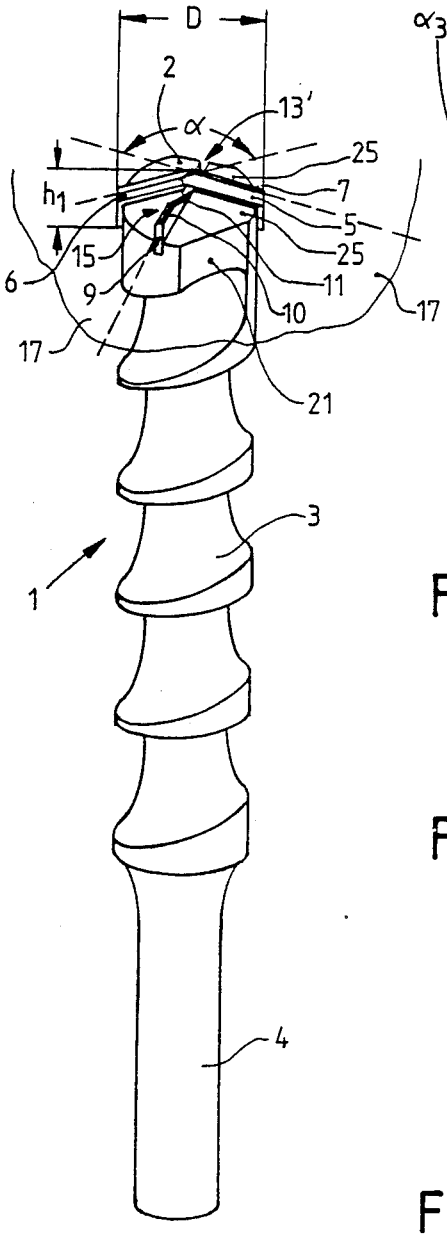
Fig. 1
Fig. 2
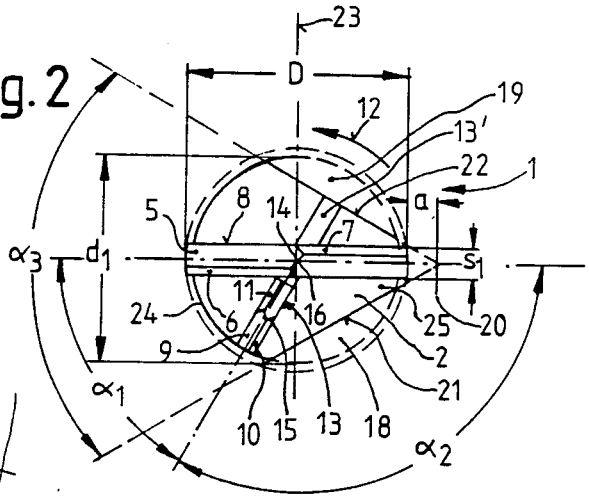
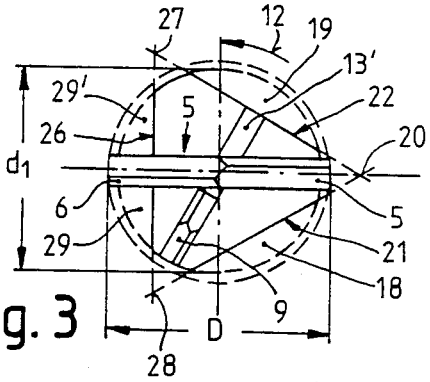
Fig. 3
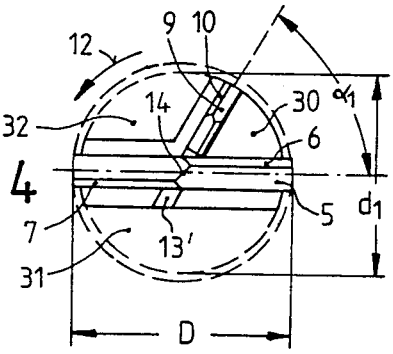
Fig. 4
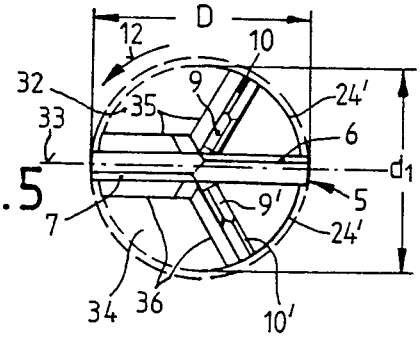
Fig. 5

ROCK DRILL

FIELD OF THE INVENTION

The invention relates to a rock drill having few cutting elements in its cutting head, and with an optional arrangement of drilling dust grooves for uniform concentric running of the drill.

BACKGROUND ART

Rock drills having carbide cutting tips are used for making drilled holes in concrete, masonry, rock or the like. In such rock drills, the end face of the drilling head is provided with at least one carbide cutting tip which generally extends over the entire diameter of the drilling head and, by the rotary-percussion or rotary-hammer action of the drill drive, applies a type of chiseling action to the stone material to be comminuted. The diameter of the drilled hole is determined by the outside diameter of the carbide cutting tip. Tools of this type have the disadvantage that the cutting edges of the cutting tip, especially in the outer area, are subjected to considerable wear as a result of the high stress so that the drilling progress rapidly decreases.

In order to reduce the surface pressure on the carbide cutting elements and thus to increase the tool life of the drilling head, cross-type cutting elements have been disclosed in which two secondary cutting tips are arranged at right angles to the main cutting tip (No. DE-A1No. -2,912,394 of the Federal Republic of Germany).

Instead of secondary cutting tips extending over the entire diameter, secondary cutting tips arranged only on the outer periphery can also be provided (the utility model No. 8,104,116).

Furthermore, No. DE-A1-3,544,433 of the Federal Republic of Germany has disclosed a rock drill in which the secondary cutting elements are designed as cutting pins which are arranged asymmetrically relative to the main cutting tip. In this arrangement, at least two and partly up to four separate cutting pins are used as additional cutting elements. This is supposed to diminish the wear on the main cutting tip.

The arrangement of a continous main cutting tip having at least two secondary cutting elements designed as secondary cutting tips or cutting pins has the disadvantage that, the drilling head must always have sufficient space to accommodate these cutting elements. But this space is used up for the arrangement for drilling-dust grooves which can lead to reduced removal of drilling dust from the drilling head. Furthermore, the manufacturing costs increase considerably with every additional carbide cutting edge, as these materials make up part of the main cost of the drilling tool.

The conventional drilling-head geometry is mostly based on a symmetric arrangement of the main and secondary cutting tips used and the associated drilling-dust grooves made between the cutting elements. But a fully symmetric arrangement or a symmetric structure of the drilling head can also lead to vibrations during use and thus to a non-uniform geometry of the drilled hole. This can occur, for example, with a drilled-head geometry according to German patent specification No. 757,056.

SUMMARY OF THE INVENTION

The object of the invention is to improve the drilling-head geometry of known drilling tools, a drilling-head cross section in particular being created which needs as few cutting elements as possible in an optimum arrangement of drilling-dust grooves, smooth and uniform concentric running of the drilling tool being achieved. In this arrangement, the positive properties of a four-edged or five-edged drill are to be maintained, but in a technically advantageous design of the drilling-head geometry.

Starting from a rock drill of the type designated at the beginning this object is achieved according to the invention by the features of a rock drill having a single-start or a double-start conveying helix, and a carbide main cutting tip having two cutting edges. Advantageous and convenient further developments of the rock drill are possible by the additional embodiments discussed below.

The invention is based on the knowledge also substantiated in particular by tests, that a drilling head of completely symmetric construction will not necessarily achieve the best drilling progress. In particular, fitting too many main tips or secondary tips to the drilling head will result in a reduced surface pressure which does not have the necessary bursting force or chiseling force to extract the rock in the drilled hole. With the invention, the conclusion is reached in particular that, apart from a continuous main cutting tip which assumes the main guidance work and the essential part of the chiseling action, only one further secondary cutting tip is actually required, which, however, is in an asymmetric arrangement relative to the main cutting tip. In this way free oscillation of the drilling head or developing vibrations are effectively prevented, which leads to better concentricity of the drilled hole. Accordingly, the invention first of all provides for the design of a so called three-edged cutting head, which results in completely new scope for developing the rest of the geometry of the drilling head. This geometry can lead in particular to a type of triangular or V-shaped drilling head, as a result of which more space is made for the drilling dust to be conveyed away. Here, the arrangement of the secondary cutting element is always asymmetric relative to the cutting edges of the main cutting tip.

In an advantageous refinement of the invention, the secondary cutting tip, just like the main cutting tip, is designed as a cutting tip configured in a roof shape. In this way, cost-effective carbide cutting tips can be used as secondary cutting tips, the secondary cutting tip having a cutting point similar to a cutting pin and therefore having an additional chiseling action similar to the design in DE No. 3,544,433 discussed above. Furthermore, the secondary cutting edge has an additional, outer cutting edge which, in a further development of the invention works in the same enveloping circle at the end face as the two cutting edges of the main cutting tip. The roof-shaped secondary cutting tip accordingly has the action of cutting pins plus an additional action of the outer cutting edges. This helps to increase the drilling progress.

The asymmetric arrangement of the secondary cutting tip is preferably made in such a way that it assumes an acute angle relative to a trailing cutting face of the main cutting tip and an obtuse angle relative to the leading second cutting face of the main cutting tip. This arrangement reduces the wear on the associated trailing cutting face of the main cutting tip, as a result of which the guidance properties and thus the drilling progress and the tool life are improved.

Furthermore, it is advantageous for the grooves for the main cutting tip and the secondary cutting tip to be designed as continous grooves extending over the entire diameter of the drilling head, the grooves meeting at the center point of the circumscribed circle of the drilled hole. In this way, the grooves are especially simple to make in the drilling head by milling a continuous recess.

The roof-shaped secondary cutting tip, in its radial extent, is preferably constructed so as to be the same as or slightly less than the diameter of the main cutting tip. In this way, the secondary cutting tip can effectively assist the main cutting tip in the guidance function and in the removal of rock.

In a preferred design of the invention, the drilling head is constructed in a V-shape or triangular shape in cross section. The flat or arched side flanks thus developing form large drilling-dust grooves which improve the drilling progress. Here, it can be advantageous in a particular design of the invention if semi-circular arc sections are formed on the circumscribed circle of the drilling head to assist guidance. Any necessary increase in the cross section to carry away the drilling dust is obtained by designing the drilling head in a triangular shape or a Y-shape. In particular applications, a second secondary cutting edge can also be provided in a symmetric arrangement relative to the first secondary cutting edge, with the main cutting tip as the plane of symmetry.

Further advantages and details essential to the invention are described in greater detail below and are shown in the drawing, in which:

BRIEF DESCRIPTION OF THE DRAWINGS

FIG. 1 shows a perspective view of a drilling tool according to the invention having three cutting edges, FIG. 2 shows a plan view of the drilling head of the drilling tool according to FIG. 1, FIG. 3 shows an alternative design of the drill head having a triangular cross section, FIG. 4 shows a further alternative design of the drill head having a V-shaped cross section, and FIG. 5 shows an alternative design of the drill head having an additional secondary cutting edge.

The rock drill shown in side view in FIG. 1 and in plan view in FIG. 2 consists of a drilling head 2 having an adjoining double-start conveying helix 3 and a chucking shank 4.

DESCRIPTION OF THE PREFERRED EMBODIMENTS

On its end face, the drilling head 2 has a main cutting tip 5 which extends over the entire diameter $d_1$ of the drilling head 2 and has a diameter D which forms the diameter D of the drilled hole. The main cutting tip 5 slopes in a roof shape at an obtuse angle $\alpha \approx 130°$ and has single cutting edges 6, 7 which are arranged at 180° relative to one another. The main cutting tip 5 has a tip thickness of $s_1$ and a height of $h_1$. It is brazed in a continuous groove 8 in the drilling head 2.

According to the invention, the drilling head 2 has a further secondary cutting tip 9 which is likewise designed as a carbide cutting tip sloping in a roof shape and having two single cutting edges 10, 11. The secondary cutting tip 9 accordingly has the same structure in principle as the main cutting tip 5, only it is designed to be smaller. The secondary cutting tip 9 is arranged asymmetrically in the drilling head 2; i.e. the secondary cutting tip assumes an acute angle $\alpha_1$ relative to the trailing single cutting edge 6 of the main cutting tip 5 and an obtuse angle $\alpha_2$ relative to the leading second single cutting edge 7. The angle $\alpha_1$ is in the order of magnitude of between 45°0 and 65°, in which arrangement $\alpha_1+\alpha_2=180°$. The direction of rotation of the drilling tool is indicated by arrow 12.

The secondary cutting tip 9 extends radially if possible up to the diameter range D of the main cutting tip 5. But as shown in FIG. 2 it extends at least up to the drilling-head diameter $d_1$.

The secondary cutting edge 9 is inserted into a groove 13 which extends over the entire drilling-head diameter and also past the center point 14 of the drilling head 2 and forms an empty groove 13' at this location. This empty groove can additionally serve to carry away drilling dust. The grooves 8, 13 extending over the entire diameter have the advantage that they are simple to produce via a milling operation. The grooves 8, 13 cross at the center point 14 of the drilling head 2.

As a result of its likewise roof-shaped design, the secondary cutting tip 9 has a cutting point 15 which, just like cutting point 16 of the main cutting tip 5, has a chiseling function when working a rock. In addition to this chiseling function, which acts like a cutting pin, the secondary cutting tip 9 has the radially outer single cutting edge 10 as an effective cutting area. For this purpose, the single cutting edge 10 lies in the same enveloping circular cone 17 at the end face as the cutting edges 6, 7 of the main cutting tip 5.

Owing to the asymmetric cutting-edge arrangement having the three effective cutting edges 6, 7 and 10, the external geometry of the drilling head 2 has a considerably different configuration as compared with conventional drilling tools. This applies in particular to the forming of large drilling-dust grooves 18, 19 in the area of the drilling head.

The drilling head in the embodiment in FIGS. 1 and 2 has an essentially V-shaped cross section whose imaginary V-shaped apex 20 lies outside the circumscribed circle having the diameter D. The drilling head is accordingly formed by the two flat side flanks 21, 22 which define the drilling-dust groove in the area of the drilling head. The angle enclosed between the side flanks 21, 22 is $\alpha_3 \approx 60°$. This leads to a flank length which extends beyond the center line 23 arranged vertically (top to bottom as seen in FIG. 2).

The arc area 24 enclosed by the two side flanks 21, 22 lies on the drilling-head circumscribed circle having the diameter $d_1$. This semi-circular arc area contains a rotational area of virtually 180° and serves to support the drill head in the drilled hole.

The intersection of the V-shaped apex 20 is arranged at a distance outside of outer diameter D of the main cutting tip in order to obtain, in this area next to the main cutting tip 5, sufficient supporting material for the main cutting tip. This area, still radiused, of the drilling head is indicated in the figure by reference numeral 25.

By the drilling-head design according to the invention having a pronounced V-shape, the drilling head has a very slim and slender appearance on account of the large drilling-dust grooves 18, 19. The asymmetric arrangement of the secondary cutting tip 9 leads to exceptionally smooth concentric running with very good drilling progress.

The exemplary embodiment in FIG. 3 differs in principle from that in FIG. 1 and FIG. 2 only by the fact that the arc-shaped area 24 connecting the side flanks 21, 22 is likewise made flat as an additional side flank 26.

In this way, virtually an equilateral triangle having the side lines 21, 22, 26 and the corner points 20, 27, 28 is formed in the circular cross section having the drilling-head diameter $d_1$. The further corner points 27, 28 are accordingly arranged to be the same as the intersection 20 also obtained in FIG. 2. By this arrangement, apart from the drilling-dust grooves 18, 19 formed by the side flanks 21, 22, an additional drilling-dust groove 29 and 29' is formed on both sides of the single cutting edge 6 of the main cutting tip 5. The arrangement of the secondary cutting tip 9 corresponds to that in FIG. 2. In addition parts which are the same in FIG. 3 are provided with the same reference numerals as in FIG. 2.

A further exemplary embodiment of the invention is shown in FIG. 4. Here the drill head is designed in a Y-shape in cross section, a drill head section 30 remaining merely between the main cutting tip and the secondary cutting tip 9. In this way, the large drilling-dust groove 31 extending over 180° is formed between the individual cutting edges, 6, 7 of the main cutting tip 5, and the second drilling-dust groove 32 extending over about 120° is formed between the secondary cutting tip 9 and the single cutting edge 6 of the main cutting tip. The secondary cutting tip 9, to be arranged asymmetrically, is offset relative to the single cutting edge 7 of the main cutting tip 5 by the angle $\alpha_1$ as described in FIG. 2.

Accordingly, the exemplary embodiment in FIG. 4 is also a three-edged drilling tool having the two cutting edges 6, 7 of the main cutting tip 5 and the cutting edge 10 of the secondary cutting tip 9. The direction of rotation of the drilling tool is as described above, again indicated by reference numeral 12.

The exemplary embodiment in FIG. 5 represents a variant of the embodiment in FIG. 4. Here, in addition to the secondary cutting tip 9 in FIG. 4, a further secondary cutting tip 9' is arranged symmetrically to the plane of symmetry 33 of the main cutting tip. This additional secondary cutting tip 9' is of identical constuction to the secondary cutting tip 9 already described. In this way the rock drill becomes a four-edged drill having the two cutting edges 6, 7 of the main cutting tip 5, the radially outer single cutting edge 10 of the secondary cutting tip 9 and also the radially outer single cutting edge 10' of the additional secondary cutting tip 9'. The secondary cutting tip 9' is arranged so as to be leading and secondary cutting tip 9 is arranged so as to be trailing relative to the single cutting edge 6 of the main cutting tip 5 (direction of rotation 12). The drilling-dust grooves 32 and 34 extending over an angle of rotation of about 120° are thereby formed. The drilling tool in FIG. 5 accordingly receives an arc area 24' as correspondingly identified in FIG. 2 by reference numeral 24.

In a combination of FIGS. 2 and 5 the side flanks 21, 22 can be designed in a V-shape in a similar manner to that represented by the flanks 35, 36 defining the drilling-dust grooves 32, 34. Likewise, these flanks can also be designed so as to be concavely arched.

The invention is not restricted to the exemplary embodiment shown and described. On the contrary, it also comprises all constructions by persons skilled in the art without separate inventive content.

What is claimed is:

1. A rock drill comprising a single-start or double-start conveying helix and a drilling head which has arranged on its end face pointing in the feed direction a carbide main cutting tip extending over the entire diameter of the drilling head, sloping in a roof shape and having two cutting edges, and at least one additional cutting element arranged asymmetrically relative to the cutting edges of the main cutting tip, wherein the additional cutting element is designed as a secondary cutting tip which has at least one cutting face and assumes an acute angle relative to the first cutting edge of the main cutting tip and an obtuse angle relative to the further cutting edge of the main cutting tip, and wherein the drilling head is designed in a V-shape, Y-shape or triangular shape in cross section, having at least two flat, V-shaped or concavely arched side flanks to form drilling-dust grooves.

2. The rock drill as claimed in claim 1, wherein the secondary cutting tip is designed as a cutting tip which slopes in a roof shape and has a center cutting point and two laterally arranged cutting edges.

3. The rock drill as claimed in claim 1, wherein the cutting edges of the main cutting tip and at the least the radially outer cutting edge of the secondary cutting tip lie on the same rotational cone arranged at the end face.

4. The rock drill as claimed in claim 1, wherein the secondary tip, relative to the single cutting edge of the main cutting tip which is located at an acute cutting angle, is arranged so as to be leading with regard to the direction of rotation of the drill.

5. The rock drill as claimed in claim 1, wherein the grooves for the main cutting tip and the secondary cutting tip extend over the entire diameter of the drilling head and run through the center point of the circumscribed circle of the drilling head.

6. The rock drill as claimed in claim 1, wherein the radial extent of the secondary cutting tip, with its outer single cutting edge, is the same as or less than the distance corresponding to the diameter of the main cutting edges.

7. The rock drill as claimed in claim 1, wherein the main cutting tip forms the angle bisector for the two side flanks.

8. The rock drill as claimed in claim 1, wherein the secondary tip forms an acute angle of about 40° to 70° relative to the trailing single cutting edge of the main cutting tip.

9. The rock drill as claimed in claim 1, wherein the drilling-head side connecting the V-shaped side flanks is designed as a semi-circular arc area which lies on the circumscribed circle of the drilling head.

10. The rock drill as claimed in claim 9, wherein the semi-circular arc area is cut off to form a triangular drilling-head cross section having an additional drilling-dust groove.

11. The rock drill as claimed in claim 1, wherein the drilling-head cross section is formed by an equilateral triangle on the circumscribed circle of the drilling head, having radiused corner areas arranged on the circumscribed circle of the drilling head.

* * * * *